US008070480B2

(12) United States Patent
Potgieter et al.

(10) Patent No.: US 8,070,480 B2
(45) Date of Patent: Dec. 6, 2011

(54) METHOD AND DEVICE FOR COMBUSTING LIQUID FUELS USING HYDROGEN

(75) Inventors: Deon John Potgieter, Monroe, LA (US); Billy Freeman Hopper, Carrollton, MS (US)

(73) Assignee: Associated Physics of America, LLC, Greenwood, MS (US)

( * ) Notice: Subject to any disclaimer, the term of this patent is extended or adjusted under 35 U.S.C. 154(b) by 1363 days.

(21) Appl. No.: 10/718,351

(22) Filed: Nov. 21, 2003

(65) Prior Publication Data

US 2005/0112517 A1 May 26, 2005

(51) Int. Cl.
*F23M 3/02* (2006.01)

(52) U.S. Cl. ..... 431/8; 431/9; 431/12

(58) Field of Classification Search ..... 431/12, 431/8 O, 9 X, 354

See application file for complete search history.

(56) References Cited

U.S. PATENT DOCUMENTS 3,982,910 A * 9/1976 Houseman et al. ..... 48/61
4,712,997 A 12/1987 Fullemann et al.
5,055,030 A * 10/1991 Schirmer ..... 431/10
5,176,324 A 1/1993 Furuse et al.
6,174,160 B1 * 1/2001 Lee et al. ..... 431/11
6,422,858 B1 7/2002 Chung et al.
6,540,505 B1 4/2003 Wuest et al.
6,739,289 B2 * 5/2004 Hiltner et al. ..... 123/3
2004/0101795 A1 * 5/2004 Fairfull ..... 431/2

* cited by examiner

*Primary Examiner* — Alfred Basichas
(74) *Attorney, Agent, or Firm* — Mark O. Loftin; Fulweider Patton, LLP

(57) ABSTRACT

A method and device for combustion of liquid fuels is presented which uses a plurality of rotating hydrogen flames to blast atomize and ignite a mechanically dispersed stream of the liquid fuel. This combustion method and device are particularly suited for heavy oil fuels, such as vegetable oils, which are not well burned using conventional burner technologies. This combustion method involves establishing a zone of combusting hydrogen and projecting a mechanically atomized dispersion of the liquid fuel into and through this zone of combusting hydrogen. The combusting hydrogen partially vaporizes and ignites the liquid fuel while the intense turbulence of the hydrogen combustion zone further disperses any remaining liquid fuel droplets. Once ignited and dispersed, the fuel oil continues to burn as it moves away from the hydrogen combustion zone. Since only a small amount of combusting hydrogen is utilized, the hydrogen can be generated by the electrolysis of water, which produces a 2:1 molar ratio of hydrogen and oxygen, or hydroxy, gas.

22 Claims, 8 Drawing Sheets

METHOD AND DEVICE FOR COMBUSTING LIQUID FUELS USING HYDROGEN

BACKGROUND OF THE INVENTION

1. Field of the Invention

This invention relates to methods of combusting high molecular weight liquid hydrocarbon fuels by co-firing with a more combustible supplemental fuel. More particularly, this invention presents a method and device that effectively combusts heavy hydrocarbon fuel oils by injecting them through a zone of combusting hydrogen where the oil is finely dispersed, partially vaporized and ignited. Since the method presented utilizes a relatively small amount of hydrogen fuel, a low-volume hydrogen source such as the electrolysis of water can be used to generate the required rates of hydrogen. Combustion of heavy oils using hydrogen generated from the electrolysis of water presents a significant achievement over present methods and devices which combust heavy fuel oils by co-firing with large amounts of natural gas. Using the combusting hydrogen to disperse the fuel oil provides the requisite degree of atomization without the need for compressed non-combustible gases, such as steam or air. When used with vegetable oils, the combustion method and device presented herein offers an economical alternative to producing heat energy using only renewable energy sources.

2. The Relevant Technology

Because high-molecular weight, or heavy liquid fuel oils are of such low volatility, a significant amount of heat and mechanical energy must be input to render these fuels into a readily combustible state. Typically, a heavy oil must be heated from ambient temperature to its flash point with even more heat applied to vaporize some of the oil molecules prior to combustion. Co-firing the heavy oil with a readily combustible gas is well known as an effective method of providing the heat load necessary to render the oil to a readily combustible state. Natural gas is presently the most common co-firing fuel since it is highly combustible and often the least costly supplemental fuel source. Natural gas is, however, a non-renewable energy source that may not readily available in some areas and may be subject to other competing domestic and industrial uses.

A majority of present burner designs employ various means of preheating, atomizing and mixing the heavy oil with the hot flue gases from the combusting co-firing fuel to improve heat transfer. Fuel atomization increases the exposed surface area of the liquid fuel, which increases the rate of vaporization. Three primary means are employed for atomizing the liquid fuel: 1) liquid feed nozzles, 2) high-pressure steam or air-assisted jetting, or 3) rotating cups. Examples of these atomizing methods include Pressure Jet Atomizers and, Steam or Air Assisted Jet Atomizers and Low pressure Air Atomizers. The Pressure Jet Atomizer utilizes high oil feed pressure to atomize the fuel into a spray of finely dispersed droplets. The fuel oil is fed into a swirl chamber by means of tangential ports in the main atomizer body. An air core is set up due to the vortex formed in the swirl chamber, which results in the fuel leaving the final orifice as a thin annular film. The angular and axial velocity of this film causes the fuel to develop into a hollow cone as it discharges from the orifice. One major problem with these types of burners is that the atomizer has a distorted spray angle as the fuel flow rates are reduced, which often results in fuel/flame impingement on the furnace walls.

The External-mix Steam Atomizer or Steam-assisted Pressure Jet Atomizer type burners are designed to make full use of pressure jet atomization at high firing rates and blast atomization at low firing rates. The external-mix style employs an atomizer with a pressure jet tip, around which is provided a steam supply channel. The steam exits this annular passage way through a gap at an angle and swirl that substantially matches the oil-spray cone angle. Since the fuel oil and steam are not pre-mixed, the output is unaffected by slight variations in the steam pressure. An alternate method is the internal-mix steam atomizer, which is comprised of two concentric tubes, a one-piece nozzle and a sealing nut. The steam is supplied through the center tube and the fuel oil through the outer tube. The outlet of the center steam tube has a number of discharge nozzles arranged on a pitch circle such that each oil bore meets a corresponding steam bore in a point of intersection. At the steam exits these nozzles, it mixes with the oil forming an emulsion of oil and steam at high pressure. The expansion of this mixture as it issues from the final orifice produces a spray of finely atomized oil.

The Rotary Cup atomizer employs a cup-shaped member that rotates at high speeds (around 5000 RPM) by an electric motor and belt drive. The fuel oil flows at low pressure into the conical spinning cup where it distributes uniformly on the inner surface and is spun off the cup rim as a very fine oil film. A primary air fan discharges air concentrically around the cup, striking the oil film at high velocity and atomizing it into tiny droplets. The rotary cup burner has good turn down ratio and is relatively insensitive to contaminants in the fuel oil. The Low-Pressure Air Atomizer employs a principle is similar to that of the rotary-cup-atomizing, but the liquid fuel is forced to rotate in a fixed cup by means of a forcefully rotating primary airflow.

Although the aforementioned burners are typically designed to combust lighter fuel oils, such as diesel fuel, they must be modified to combust heavier fuel oils. Typical modifications include equipping the combustion chamber or the area around the oil filming/atomizing device with a plurality of ports where a natural gas can be fed to the combustion zone. The natural gas is ignited first and the oil flow is started once a stable gas flame is established. As the molecular weight of the fuel oil increases, the amount of natural gas required to completely combust the oil also increases. Although natural gas is presently the most common co-firing fuel, the amount required to thoroughly combust a heavy oil can be substantial.

Hydrogen is generally known to be an improved co-firing fuel primarily because its heat of combustion and adiabatic flame temperature are much higher than methane, the primary constituent of natural gas (61,100 btu/ft3 versus 23,879 btu/lb on a gross basis, 3,861° F. versus 3,371° F.). For a typical direct co-firing burner, more than 2.5 times as much natural gas would be theoretically required to produce the same amount of heat as a given mass of combusting hydrogen. Also, hydrogen is further preferred over natural gas because it can be generated from renewable energy resources and its combustion product, water vapor, is more friendly to the environment. However, simply replacing natural gas with hydrogen is not generally feasible because even 2.5 times less gas rate would still constitute a significant hydrogen demand for a standard industrial-sized burner and methods do not presently exist that can economically generate and store large volumes of hydrogen for such an application.

Although the potential benefits of using hydrogen as a co-firing fuel are generally known, the practical difficulties of handling and combusting hydrogen have largely prevented the development of useful combustion devices employing hydrogen as a co-firing fuel. Hydrogen's extreme combustibility makes its generation, storage and handling expensive and potentially dangerous. Secondly, hydrogen's flame velocity is more than 8 times as fast as a typical heavy fuel oil flame velocity. This characteristic makes co-firing by conventional burners largely ineffective because the hydrogen burn rate substantially outpaces the fuel oil burn rate and the flame propagation may not be stable without a large excess of hydrogen.

SUMMARY AND OBJECTIVE OF THE INVENTION

The inventors understood that effective utilization of hydrogen as a co-firing fuel for heavy fuel oils would require a novel combustion method that could accommodate the special characteristics of combusting hydrogen and use relatively small quantities. The inventors felt that the favorable properties of hydrogen, i.e. high combustion heat and rapid flame velocity, could be harnessed to combust a class of liquid fuels, which are abundantly available and renewable but are not economically combusted using present methods or devices. Also, by reducing the volume of hydrogen required, a relatively simple method such as the electrolysis of water, could be used to generate the hydrogen "on-demand," eliminating the need for complex hydrogen generation and storage methods that might otherwise be required. Although the heavy oil fuels preferred by the inventors for this application are raw vegetable oils, the concept and application can be usefully applied to a broad range of other combustible liquid fuels.

It is the objective of this combustion method and device to provide an economical option to the production of heat energy completely from renewable fuels, such as bio-fuel oils and hydrogen, where the value of the heat energy produced exceeds the sum costs of the fuels, equipment, and power input to produce that heat energy.

It is still a further objective of this combustion method and device to provide an effective means of combusting these heavy oil fuels utilizing hydrogen generated "on demand" by the electrolysis of water such that no ancillary equipment for separation, compression or storage of hydrogen is required and safety is maintained by minimizing the volume of hydrogen staged within the system.

DETAILED DESCRIPTION

Figure 1:
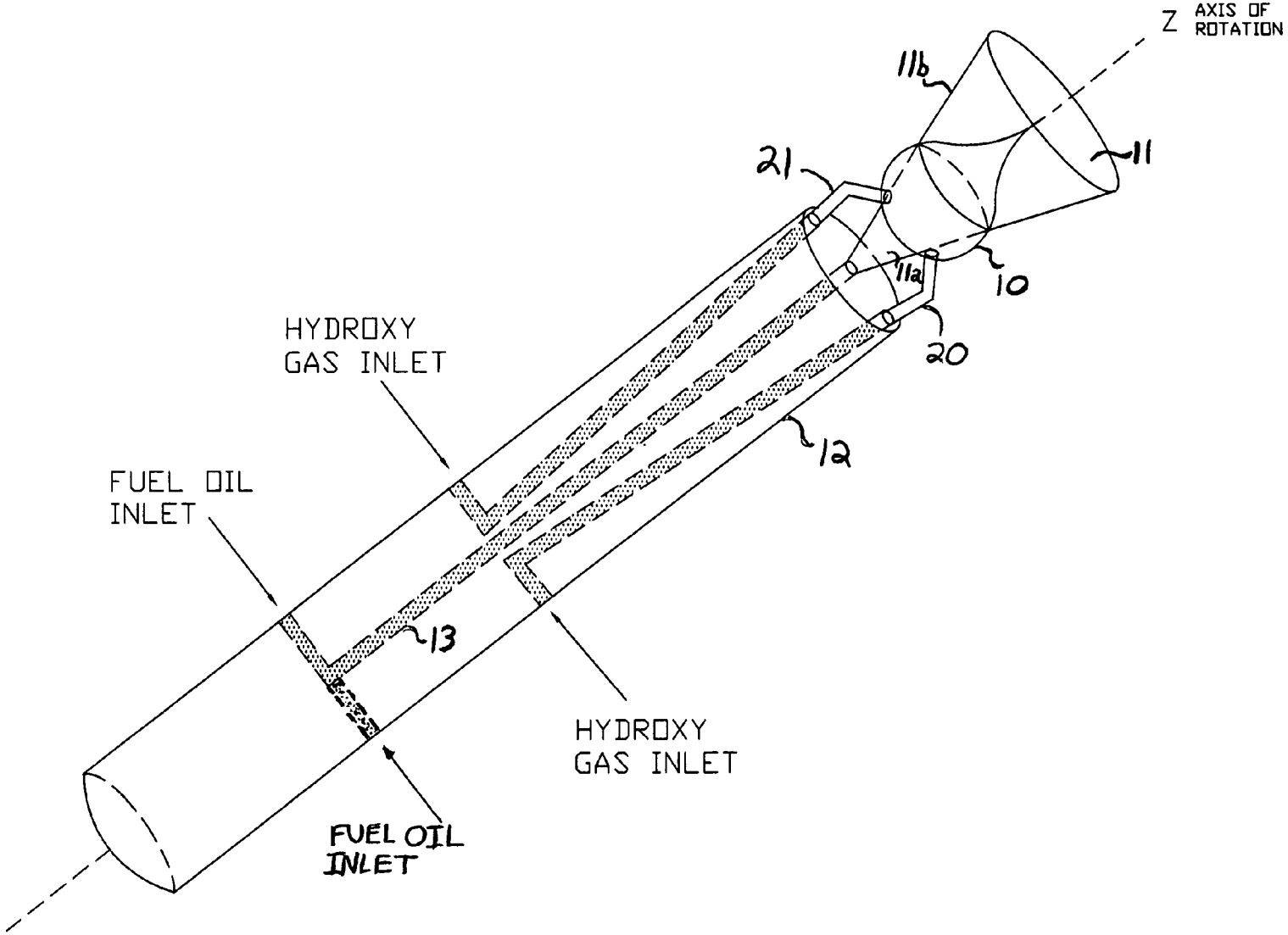
FIG. 1 shows a three-dimensional view of the combustion method presented by the inventors where the simulated, conically-shaped zone of combusting hydrogen is established by the rotating shaft and the heavy oil fuel is injected into the base of this cone. A simplified representation of the hydroxy and fuel oil combustion zones is shown to demonstrate the mechanics of the combustion as anticipated by the inventors.

The graphic representation shown in FIG. 1 depicts the basic features of the combustion method and device developed by the inventors. The basic principle involves the use of a small quantity of combusting hydrogen to blast atomize and ignite the heavy oil fuel. Small hydrogen flames are established by igniting hydrogen gas as it exits a plurality of feeding tubes 20 and 21. As the shaft 12 is rotated about axis Z at sufficiently high speeds, the hydrogen flames at the tips of the feeding tubes form a near continuous zone of combusting hydrogen 10 as shown in the figure as a conical spheroid. The liquid primary fuel travels through tube 13 along the axis of rotation Z and is first atomized into the base of the hydrogen combustion zone 10.

In continued reference to FIG. 1, in zone 11*a*, the atomized primary fuel oil exiting the rotating shaft 12 is sensibly heated by the intense radiant and convective heat emanating from the hydrogen combustion zone 10. As the primary fuel oil fuel enters zone 10, the contact with the combusting hydrogen gases vaporizes and ignites some portion of the primary fuel. Any remaining atomized oil droplets that are not vaporized are sheared into an extremely fine micro-dispersion by the intense turbulence created in zone 10 by the combustion and rotation of the hydrogen flames. The dispersed primary fuel leaving zone 10 is comprised of mostly partially heated micro-dispersed oil droplets surround by a lesser amount of combusting, vaporized primary fuel. Zone 11*b* depicts the downstream zone where the heat generated by the combusting primary fuel is used to complete the remaining vaporization required to combust all of the primary fuel. This method produces a primary fuel flame extending several feet away from the hydrogen combustion zone 10, which allows for most of the primary fuel combustion to take place without interference by the hydrogen combustion.

Using hydrogen flame turbulence as a second stage blast atomizing means overcomes two significant problems encountered with combustion of heavy fuel oils. First, the method produces a significantly smaller liquid fuel droplet size in the combustion zone than is achievable by typical atomizing nozzles or orifices, without the need for preheating the fuel or injecting compressed air or steam. Secondly, it partially vaporizes a small quantity of the fuel oil and disperses that vapor throughout the primary fuel/air mixture so that once ignited, the heat of the combusting fuel oil vapor is more efficiently utilized to further vaporize any remaining liquid fuel.

An additional feature of this combustion method is the continuous ignition of the vaporized portion of the primary fuel oil by high-speed rotation of the hydrogen flames. As the atomized primary fuel travels past the tips of the hydroxy gas tubes 20 and 21, any vaporized primary fuel must first be ignited. This ignition occurs as one of the rotating hydrogen flames fronts extending outwardly from the tips of the hydroxy gas tubes contacts the vaporized primary fuel. Experimentation showed that as the rotational speed of the rigid shaft dropped below the forward flame velocity of the hydrogen, the primary fuel's combustion efficiency began to decrease, resulting in smoking of the flame. This is thought to be due to the decrease in coverage of the hydrogen flames in the area above the feeding tubes. At rotational speeds less than the forward flame velocity of the hydrogen, some of the primary fuel appears to pass through zone 10 without contacting a hydrogen flame front, thus decreasing dispersion, vaporization and ignition efficiency of the primary fuel. This theory is supported by additional experiments that showed increasing the rotational speed above the forward flame velocity of the hydrogen did not provide any increase in combustion efficiency or primary fuel flame stability. The inventor's chose a standard speed achievable by readily available motors that produced a rotational speed of the hydrogen flames greater than 8.0 feet per second. For the size burner tested by the inventors, 400 liters per hour of hydroxy gas were required to effectively burn 25 gallons per hour of cottonseed oil.

Oxygen to support the combustion of hydrogen in zone 10 is best supplied by pre-mixing the hydrogen and oxygen prior to entering the feed tubes 20 and 21. This is most easily done by using the electrolysis of water as the hydrogen source since the "hydroxy" gas produced is already in the proper stoichiometric proportion for combustion. Oxygen to support the combustion of the heavy oil is supplied by ambient air, which can be drafted into zone 11*b* by an external air fan. One drawback to the use of hydrogen as a co-firing fuel is that the high flame temperature of combusting hydrogen can oxidize nitrogen present in the draft air and create NOx emissions that are undesirable. By using hydrogen and oxygen from electrolysis, ambient air is not necessary to fuel the hydrogen's combustion. Thus, since nitrogen gases are virtually nonexistent in the hydrogen combustion zone, very little if any NOx is generated from the high-temperature hydrogen combustion zone.

The shapes and combustion zone interactions depicted in Figures are greatly simplified for purposes of disclosing the underlying principals involved with this combustion method. Variations in the heavy oil fuel properties, air draft rate, fuel atomization, fuel feed rate and orientation of the burner will result in distortions of these shapes. Also, these shapes are not in reality smooth conical shapes but rather zones of somewhat conical proportions where the peak of the combustion events occur. In an alternate embodiment of this combustion method, multiple zones of combusting hydrogen can be established downstream of zone 10 along the axis of rotation to provide additional heat energy heat to ensure efficient combustion of even heavier fuels. Such multiple-staged hydroxy combustion zones can be created by additional hydroxy feeding tubes projecting outwardly from the rotating shaft or by surrounding the rigid shaft 12 with a second shaft, rotating in an opposite direction along the same axis.

To accomplish this combustion method, the inventors had to overcome several issues relating to the transport of the hydroxy gas from the electrolytic cell where it is generated into the rotating shaft 12 and through to the tips of the tubes 20 and 21 where the hydrogen combustion occurs. First, hydroxy gas is extremely combustible and will auto-ignite at relatively low pressures when heated. Radiant and convective heat from the combustion zones 10 and 11 will tend to heat the burner components near the combustion area. To prevent thermal-induced auto-ignition before the hydroxy gas reaches the tips of the tubes, the inventors were required to keep the feed gas pressure as low as possible. However, when the shaft 12 is rotated, centrifugal forces act to prevent molecules from entering the feeding tubes. Also, since oxygen has a higher molecular weight than hydrogen, the centrifuge effect created by the rotating shaft tends to move oxygen molecules away from the axis of rotation relative to the hydrogen, which causes separation of the hydrogen and oxygen molecules inside the feeding tubes.

Figure 2:
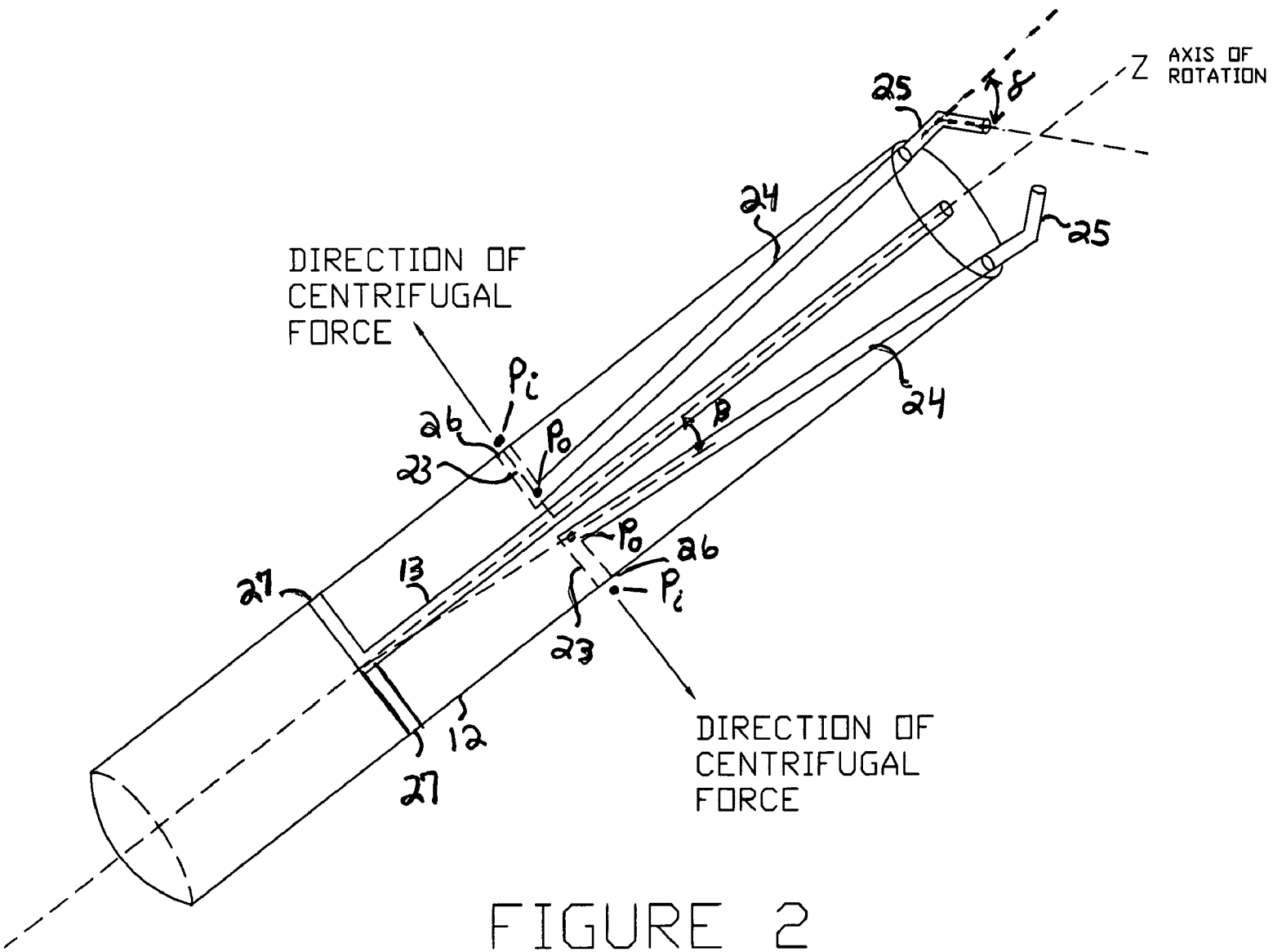
FIG. 2 shows a similar three-dimensional arrangement and configuration in FIG. 1 where the critical geometric design angles of these feeding tubes are identified.

As best shown in FIG. 2, each feeding tube can be broken down into three subsections, an inlet channel 23, a shaft channel 24, and an outlet channel 25. When the shaft 12 is rotated, a centrifugal force develops radially outward from the axis of rotation, which acts as a resistance to flow of hydroxy gas into the inlet channel 23. This resistance can be overcome by either increasing the feed gas staging pressure at point Pi or decreasing the pressure at point Po, where the feeding tube inlet channel 23 and the shaft channel 24 intersect. The inventors chose to lower the pressure at point Po because the hydroxy gas is safer to handle at low pressures. The pressure at point Po was lowered by angling the shaft channel 24 an angle beta relative to the axis of rotation Z. By angling the shaft channel 24, the centrifugal force developed under rotational tends to move the hydroxy gas molecules away from point Po, which results in a decrease in gas pressure at Po. Therefore, a sufficient capillary force created by pressure differential (Pi−Po) to induce flow through the inlet channel 23 can occur without significantly increasing the pressure Pi and increasing the auto-ignition potential of the upstream hydroxy feed gas.

The rotation of the shaft 12 at sufficiently high speeds created a second problem of separation of the hydrogen and oxygen molecules inside the shaft chamber 24. This separation tends to destabilize the flames at the tips of the tubes because the hydrogen and oxygen are not adequately mixed before entering the combustion area. The inventors overcame this problem by inducing mixing turbulence inside the outlet channel 25 just prior to exiting into the combustion zone. This mixing turbulence results from the change in flow direction relative to the axis of the shaft channel 24 as represented by the outlet tip angle gamma. A stable hydrogen flame was found to be produced with an angle gamma of 40-50 degrees. Angles greater than this resulted in increased hydrogen and fuel oil flame-outs (i.e., loss of ignition) and ineffective envelopment of the fuel oil in the zone of combusting hydrogen.

The inventors' preferred means of creating the oil feeding tube 13, the inlet channel 23, and the shaft channel 24 as shown in FIG. 2 was to machine these channels as void spaces in a solid metal shaft 12. The outlet channel 25 is manufactured from metal tubing of the same bore diameter and is threaded on one end for connecting to the shaft. The diameter of these circular void spaces and tubing will vary depending on the thermal rating of the burner. The entrance to the hydroxy gas feeding tubes occurs at circular openings 26, which open to the outer surface of the metal shaft 12. The fuel oil enters the shaft to the oil feeding tube 13 at opening 27.

Figure 3:
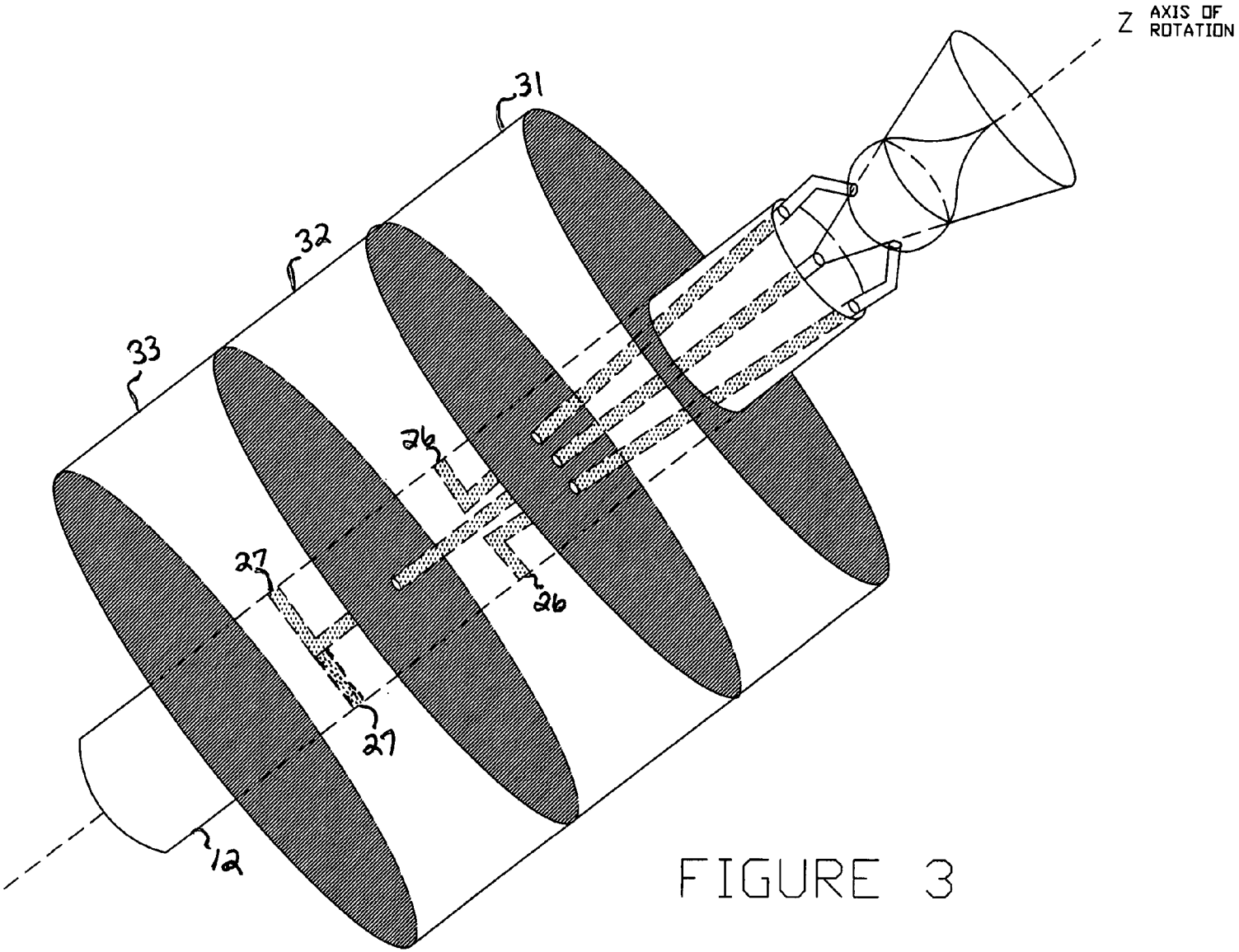
FIG. 3 shows a third three-dimensional arrangement of the hydroxy gas feeding tubes, the forward coolant staging chamber, the middle hydroxy gas staging chamber, and the rear fuel oil staging chamber.

As best seen in FIG. 3, a plurality of cylindrical staging chambers are formed around the shaft 12 to contain the various gases and liquids associated with the burner's operation. In the embodiment presented in FIG. 3, there is a forward coolant staging chamber 31, a middle hydroxy gas staging chamber 32, and a rear fuel oil staging chamber 33. Each of these staging chambers provides a sealed compartment where the fluids can surround the rotating shaft such that the inlet openings 26 and 27 to the feeding tubes are always exposed to the staged fuels to maintain constant flow. The chambers also provide a fixed volume whose pressure can be controlled to regulate the flow of the fuels into the burner tip area. The forward coolant staging chamber 31 is a multipurpose chamber that is primarily used to shield the hydroxy storage chamber 32 from the radiant and convective heat emanating from the combustion zone. This heat can be removed by circulating a cooling fluid through the chamber, circulating the liquid oil fuel through the chamber prior to entering the rear fuel oil staging chamber 33, or circulating a mixture of the liquid fuel and water. In an alternate embodiment, the forward chamber can be used as a third material feeding stage, which could either have a separate inlet hole connecting to the liquid fuel shaft or could have its own feeding tube, or a plurality of tubes, discharging the contents of the forward chamber into the combustion zones separately.

Although the inventors' preferred embodiment utilizes three staging chambers, for liquid fuel, hydroxy gas and cooling fluid, more chambers could be added to accommodate a range of other materials to be injected into the combustion zone, such as environmental wastes or additives to control smoking, and others. The shaft length can be extended as necessary to accommodate the additional staging chambers. Multiple feeding tubes can also be bored into the shaft to provide transport conduits for the contents of these additional chambers.

Figure 4:
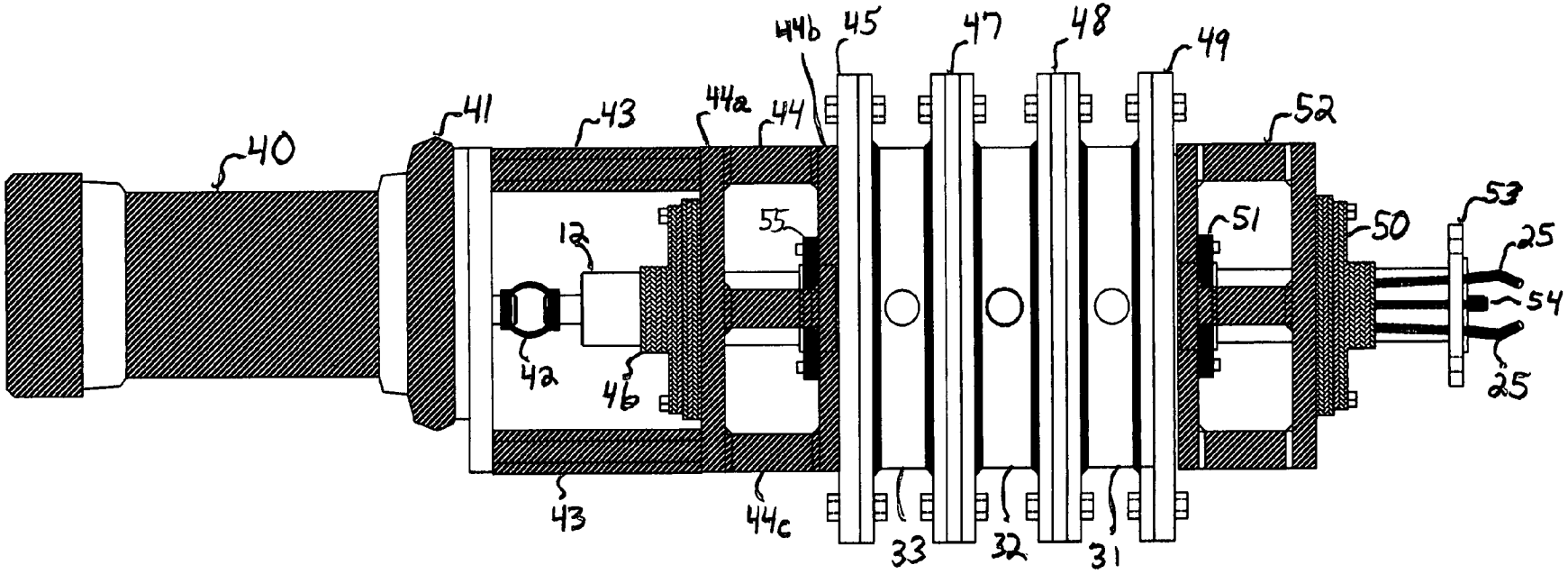
FIG. 4 shows a side view of the assembled burner developed by the inventors to carry out this combustion method.

FIG. 4 best shows the complete device made by the inventors to effectively carry-out this combustion method. It is comprised of a AC motor 40 that is coupled to the rigid metal shaft 12 via a gear reducer 41. In an alternate embodiment, the gear reducer is omitted and the motor is directly coupled to the rigid shaft. This embodiment may be used where the rotational speed of the motor is sufficient to provide a stable hydrogen flame. A flexible coupling 42 is installed to facilitate alignment of the motor and shaft. The motor 40 is connected to the main body of the burner by a plurality of metal spacers 43 that are threaded on each end for receiving a fastening bolt. One end of these metal spacers is attached to the gear reducer 41 while the other end is connected to a rear bearing holder bracket assembly 44. The rear bearing holder bracket assembly is comprised of two square-shaped metal flanges 44*a* and 44*b* that are attached together by welding to each end of a plurality of short metal spacers 44*c*. The forward flange face 44*b* is drilled to receive a plurality of fasteners that connect the bracket holder assembly 44 to the rear chamber mating flange 45. A square shaped cut-out is made in the center of the forward flange face to accommodate the mechanical seal flange 55. A separate plurality of holes are drilled and tapped into the rear flange face 44*a* to receive retaining bolts for a rear bearing assembly 46. A short section of the end of rigid shaft 12 connecting to the motor coupling is machined back to a slightly smaller diameter than the main shaft diameter so that the shaft cannot slip through the rear bearing 46 when assembled. The forward face of the forward flange 44*b* has a raised disk face extending axially from the centerline of the flange that matches a recess machined into the rear face of the rear cap flange 45.

Figure 5:
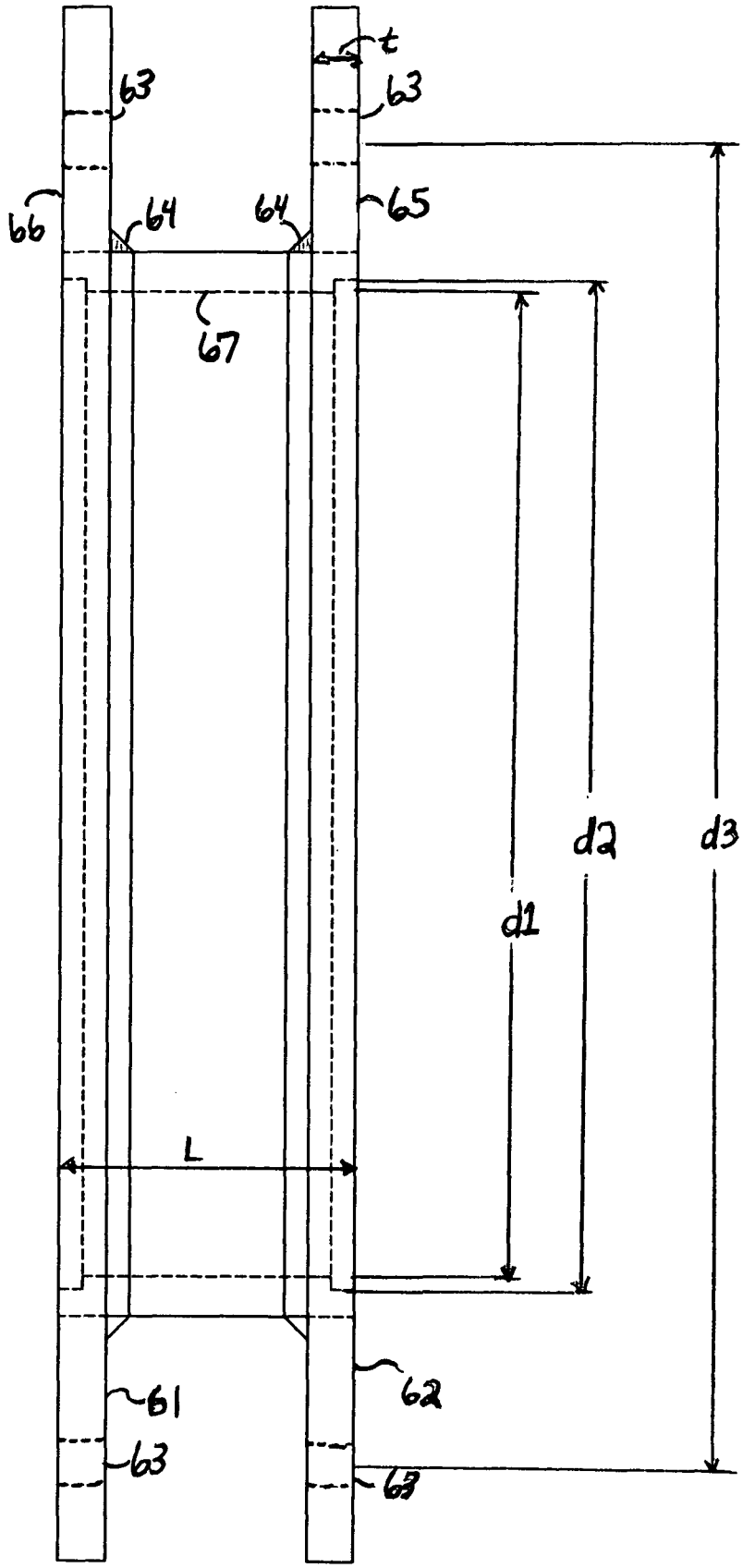
FIG. 5 shows a side view of one of the staging chambers.

The rear fuel oil staging chamber 33, the middle hydroxy staging chamber 32, and the forward cooling fluid staging chamber 32 are each comprised of forward and rear circular mating flanges welded on the ends of a center tube. FIGS. 5 shows a side view of one of these staging chambers comprised of the circular mating flanges 65 and 66, and the center tube 67. These mating flanges 65 and 66 are circular shaped metal disks with an inner recess of diameter d2 machined slightly larger than the inside diameter of the center tube to a depth approximately one-half of the flange thickness t. A plurality of bolt holes 63 are drilled along an outer bolt diameter d3 for receiving a plurality of bolts which fasten one chamber to another. The flange thickness t is that necessary to provide a sufficiently rigid body that can withstand the pressures inside the chamber and can maintain planar shape during the machining process. The number of bolt holes can match any ANSI bolt pattern sufficient to withstand the pressures inside the chamber and ensure adequate sealing. Each staging chamber can be defined as an annular void space around the shaft 12. The length of each chamber's center tube L marks the axial bounds of the chamber while the diameter of the center tube d1 marks the radial bounds of each chamber. These axial and radial bounds are limited only by the dimensions necessary to accommodate internal mechanical seals around the rotating shaft inside the forward and rear staging chambers. Each chamber tube has a inlet port for receiving the fuel streams. The forward coolant staging chamber has two ports so that the oil fuel/water mixture can be circulated through the chamber before entering the rear fuel oil staging chamber.

Figure 6:
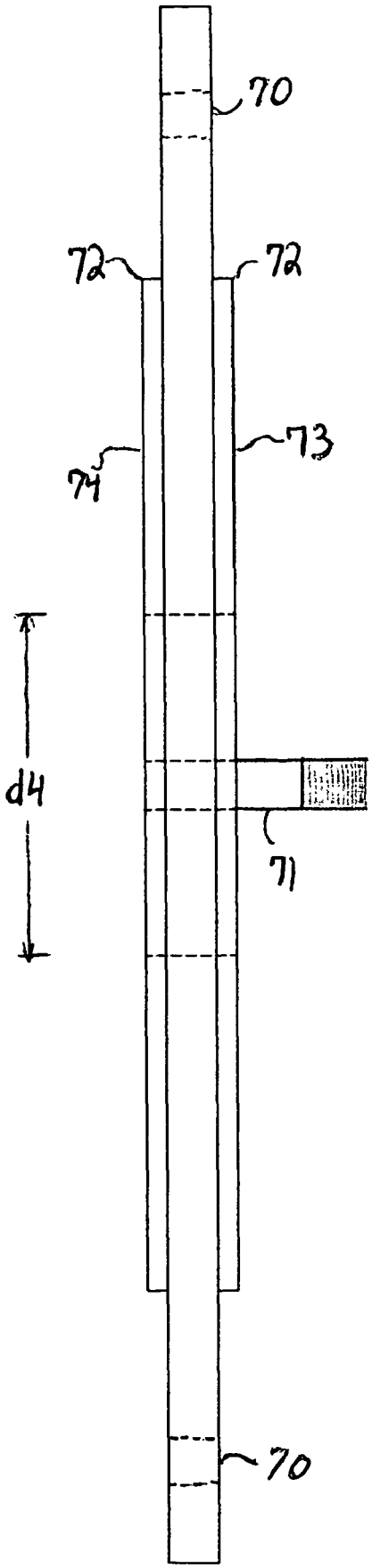
FIG. 6 shows a side view of one of the spacer plates located on either side of the middle hydroxy gas staging chamber.

Referring back to FIG. 4, in between the mating flanges of the forward and rear staging chambers and the mating flanges of the middle hydroxy staging chamber are two spacer plates, 47 and 48. FIG. 6 shows a side view of one of these spacer plates with a inner face 73 facing into the either the forward or rear chamber and an outer face 74 facing into the middle hydroxy staging chamber. Each spacer plate is comprised of a circular metal disk with a plurality of bolt holes 70 drilled about an outer bolt diameter equivalent to the bolt diameter of the chamber mating flanges. The spacer plates have an inner hole d4 machined slightly larger than the outer diameter of the sleeve of the mechanical seal, which fits around the central diameter of the rigid shaft 12. On either side of the inner hole, a pair of studs 71 are welded into the body of the spacer plate to match the fastener slots on the internal mechanical seals. A raised face 72 is machined into each side of the space ring to match with the recess of diameter d2 in FIG. 5. The machined raised face and matching recess ensure very precise alignment of the chambers, spacer plates and internal mechanical seals around the rigid shaft 12.

Figure 7:
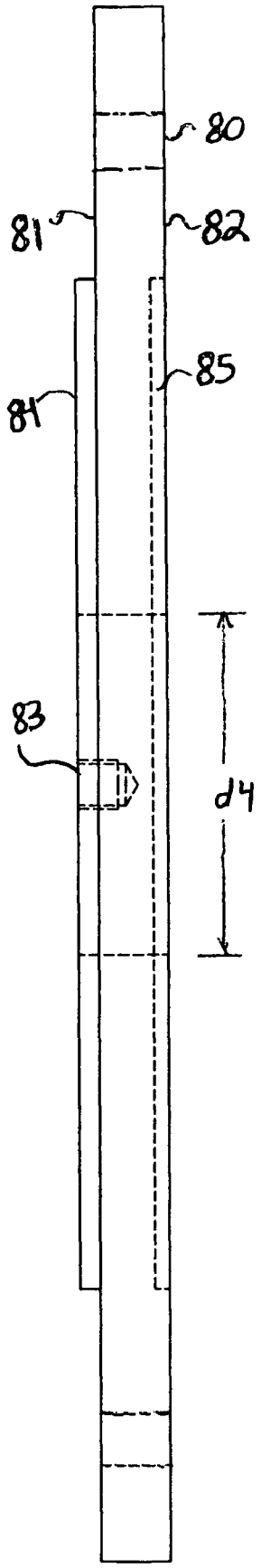
FIG. 7 shows a side view of one of the cap flanges located on the forward and rear ends of the staging chamber section of the burner.

Referring back to FIG. 4, two cap flanges 45 and 49 are used to seal the outer sides of the front and rear chambers. FIG. 7 shows a side view of one of these cap flanges. Each cap flange is comprised of a circular metal disk with an inner face 81 facing into the either the forward or rear chambers and an outer face 82 that mates to the forward or rear bearing bracket assembly. A plurality of bolt holes 80 are drilled about an outer bolt diameter equivalent to the bolt diameter of the chamber mating flanges. The cap flanges have an inner hole d4 machined slightly larger than the outer diameter of the sleeve of the mechanical seal, which fits around the central diameter of the rigid shaft 12. Into the inner face 81, on either side of the inner hole d4, a pair of bolt holes 83 are drilled and tapped into the body of the cap flange to receive the retaining bolts for the mechanical seal. A raised face 84 is machined into the inner face 1 to match with the recess of the chamber mating flanges at diameter d2 in FIG. 6. A circular recess 85 is machined into the outer face 82 for mating with the raised face on the forward or rear bearing bracket assembly.

Figure 8:
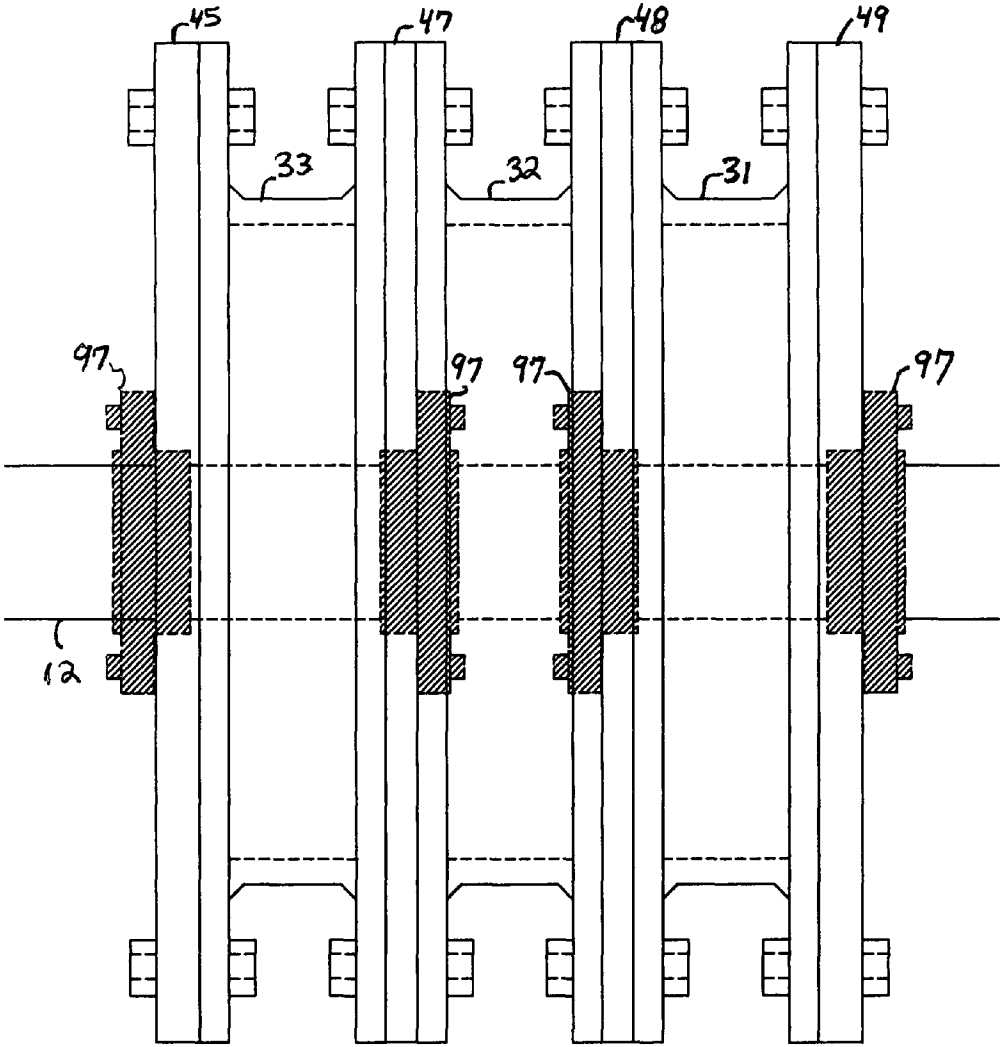
FIG. 8 shows a side view of the staging chamber section of the burner where the location of the internal mechanical seals are shown

FIG. 8 shows a side view of the rigid shaft 12 surrounded by the three staging chambers 33, 32 and 31. The location of the internal mechanical seals 97 are shown bolted to and projecting away from the spacer plates 47 and 48 and the cap flanges 45 and 49. The mechanical seals are of a single bellows type commonly used in centrifugal pumps and minimize leakage of fluids from either the forward or rear staging chambers into the middle hydroxy staging chamber. Access to the retaining bolts is through the inlet ports to the chambers. In an alternate embodiment, the middle hydroxy staging chamber can be made substantially square with one of the sides comprising of a removable panel. This embodiment provides an alternate access means to tighten the retaining bolts for the mechanical seals.

Referring back to FIG. 4, a second forward bearing assembly 50 identical to the rear bearing assembly 46 is provided near the burner tip end to ensure alignment once the burner becomes heated. A forward bearing bracket assembly 52 is provided to secure the forward bearing around the shaft 12. A short section of the flame end of rigid shaft 12 connecting to the burner tip flange 53 is machined back to a slightly smaller diameter than the main shaft diameter so that the shaft cannot slip through the forward bearings 50 and 51. The rear face of the forward bearing bracket assembly also has a raised disk face extending axially from the centerline of the flange that matches a recess machined into the outer face of the forward cap flange 49 and a cut-out to accommodate the flange of the mechanical seal 51. A circular metal burner tip flange 53 is secured by plurality of fasteners to the end of the rigid shaft 12. This burner tip flange provides a removable part that can be easily modified to accommodate different combustion configurations which may be required to adapt the burner to other fuel types. The hydroxy gas outlet channels 25 are connected to the face of the burner tip flange and are oriented so that the exit points toward the axis of rotation. A standard-type spray atomizing nozzle 54 is connected to the face of the burner tip flange along the center axis for spraying the fuel oil into the zone of combusting hydrogen. This atomizing nozzle can be easily removed to accommodate a variety of fuel types and a variety of spray patterns to optimize combustion for a given fuel type.

In continued reference to FIG. 4, two ports 55 and 56 are provided into the coolant staging chamber for circulating a fluid. One hydroxy gas inlet port 57 is provided for connection to a hydrogen or hydroxy gas fuel source. A fourth port 58 is provided in the rear fuel staging chamber for connecting to a pressurized liquid fuel source.

The invention claimed is:

1. A method of combusting a liquid primary fuel comprising the steps of:

establishing a first zone of combustion formed by radially inwardly directed intersecting flames comprised essentially of burning hydrogen gas supplied from an external source and spaced from a fuel nozzle, establishing a second zone of combustion comprising an atomized primary fuel that is ignited by contact with the first zone of combustion.

2. The method of claim 1 wherein the first zone of combustion is established by the steps of:

providing a pressurized source of hydrogen through a conduit having a discharge opening adjacent to said first zone of combustion, igniting the hydrogen exiting through said discharge opening to produce a hydrogen flame; and mechanically rotating the hydrogen flame about a longitudinal axis of the first zone of combustion.

3. The method of claim 2, further comprising the step of setting a speed of the rotating hydrogen flame to optimize a combustion efficiency of the primary fuel.

4. The method of claim 2 wherein said discharge opening is radially spaced from said longitudinal axis and angled toward the central axis of rotation.

5. The method of claim 2 wherein a speed of the rotating hydrogen flame in a circumferential direction is not less than the forward flame velocity of the ignited hydrogen.

6. The method of claim 2 where the hydrogen flowing through the conduit includes at least a stoichiometric amount of oxygen to sustain combustion of the hydrogen.

7. The method of claim 6 wherein that predetermined mixture of hydrogen is a molar ratio of hydrogen to oxygen having a value of 2:1.

8. The method of claim 2 where the step of providing pressurized hydrogen from the hydrogen source further includes the steps of:

generating a constant rate of hydrogen and oxygen gases from the electrolysis of water, and transferring the hydrogen and oxygen gases into a fixed-volume staging chamber such that the hydrogen and oxygen gases are continuously exposed to an inlet opening of the conduit.

9. The method of claim 2 further comprising the steps of providing a second conduit for delivering hydrogen through a second discharge opening adjacent to the first zone of combustion, igniting the hydrogen discharging through said second discharge opening to produce a second hydrogen flame, and rotating said second hydrogen flame about the longitudinal axis.

10. The method of claim 9 further comprising the steps of providing a plurality of additional conduits for delivering hydrogen through additional discharge openings with said additional discharge openings extending radially outward from the longitudinal axis relative to the first two hydrogen discharge openings, igniting the hydrogen discharging through said additional conduits to produce a plurality of hydrogen flames, and rotating said plurality of hydrogen flames about the longitudinal axis in the same rotational direction as said first and second discharge openings.

11. The method of claim 10 where the plurality of additional conduits for delivering hydrogen are rotated in a direction opposite to the first and second conduits along the longitudinal axis.

12. The method of claim l wherein said step of dispersing said liquid primary fuel further comprises flowing a pressurized source of liquid primary fuel through a conduit of a rotating shaft and including a discharge end having an atomizing nozzle to discharge the liquid primary fuel into the zone of combustion.

13. The method of claim 1 where said primary fuel is selected from the group comprising processed and unprocessed vegetable oils, by-product oils from agricultural products processing, liquid and liquefied petroleum fuels, and liquid and liquefied animal fats.

14. The method of claim 1 further including a step of injecting a controlled rate of an additive selected from steam or water into the first zone of combustion.

15. The method of claim 14 wherein the injection of said additive is accomplished by pre-mixing the additive at a controlled rate with the liquid primary fuel.

16. The method of claim 1 wherein the first zone of combustion is defined by generally conical surface symmetric about a longitudinal axis.

17. A burner for combusting a liquid primary fuel and hydrogen comprising:

a rotating shaft with a proximal end and a distal end connected to a burner tip, a pair of circular hydrogen transport channels formed inside the rotating shaft, each channel having an inlet portion with an inlet port communicating exterior to the shaft for receiving the hydrogen from a source, and an axial portion extending from said inlet portion longitudinally to a burner tip flange, a primary fuel conduit formed inside the shaft, said conduit having an inlet port for receiving the liquid primary fuel and an axial portion running perpendicular to the longitudinal axis of the shaft for transporting the primary fuel from the inlet port to the burner tip flange, a coolant chamber formed around the shaft closest to the distal end for containing a circulating coolant fluid, a hydrogen chamber containing a pressurized hydrogen gas source in fluid communication with said hydrogen transport channels, and a primary fuel chamber containing a pressurized primary liquid fuel in fluid communication with said primary fuel conduit.

18. The burner of claim 17 where the axial portion of the hydrogen transport tubes extends away from the longitudinal axis of the shaft at an angle between 10 and 30 degrees relative to the longitudinal axis.

19. The burner of claim 17 wherein the burner tip is comprised of:

a solid circular flange having a proximal face attached to the end of the shaft, a distal face adjacent to a combustion zone, a hole for passing the liquid primary fuel from the primary fuel conduit and a pair of holes for passing the hydrogen from the hydrogen transport tubes, a pair of hydrogen discharge tubes extending from the hydrogen holes and projecting away from the distal face of the flange in an axial direction with respect to said shaft, and then in a direction which intersects the longitudinal axis of said shaft; and a liquid dispersing nozzle disposed at the primary fuel hole for discharging the primary fuel into the combustion zone.

20. The burner tip of claim 17 where said hydrogen discharge tubes include a first axial portion having a length between 0.5 and 3 inches, an inwardly directed portion having a length between 0.5 and 3 inches, and wherein said axial direction is defined by an angle between 22 and 60 degrees relative to the axial centerline of said axial portion of said hydrogen transport tubes.

21. The burner of claim 17 further including an electrolytic cell for generating hydrogen and oxygen gases connected to the hydrogen chamber, where the rate of hydrogen being fed to the burner is controlled by varying the surface area of the electrolytic plates and the current input to the electrolytic cell.

22. The burner of claim 17 further including a fourth chamber around the shaft for staging a secondary material to be injected into a combustion zone, with the shaft including additional transport tubes located therein for transporting the secondary material to the burner tip.

* * * * *